US011306480B2

(12) United States Patent
Phillips et al.

(10) Patent No.: US 11,306,480 B2
(45) Date of Patent: Apr. 19, 2022

(54) RECESSED MOUNTING APPARATUS

(71) Applicants: Brian Oliver Phillips, Woodruff, SC (US); Richard Anthony Fling, II, Blythewood, SC (US)

(72) Inventors: Brian Oliver Phillips, Woodruff, SC (US); Richard Anthony Fling, II, Blythewood, SC (US)

( * ) Notice: Subject to any disclaimer, the term of this patent is extended or adjusted under 35 U.S.C. 154(b) by 0 days.

(21) Appl. No.: 16/834,864

(22) Filed: Mar. 30, 2020

(65) Prior Publication Data

US 2020/0308831 A1 Oct. 1, 2020

Related U.S. Application Data

(60) Provisional application No. 62/826,602, filed on Mar. 29, 2019.

(51) Int. Cl.

| | |
|---|---|
| ***E04B 9/18*** | (2006.01) |
| ***E04B 9/06*** | (2006.01) |
| ***E04B 9/00*** | (2006.01) |

(52) U.S. Cl.

CPC ..... *E04B 9/18* (2013.01); *E04B 9/006* (2013.01); *E04B 9/06* (2013.01)

(58) Field of Classification Search

CPC ... E04B 9/18; E04B 9/06; E04B 9/006; E04B 9/0478

See application file for complete search history.

(56) References Cited

U.S. PATENT DOCUMENTS

| | | | | |
|---|---|---|---|---|
| 5,401,094 | A * | 3/1995 | Walsten | A47B 67/02 312/242 |
| 6,029,414 | A * | 2/2000 | MacLeod | E04B 9/006 248/231.81 |
| 7,631,848 | B2 * | 12/2009 | Enochs | G03B 21/14 248/327 |
| 2008/0259616 | A1 * | 10/2008 | Morgan | E04B 9/0464 362/404 |
| 2011/0259665 | A1 | 10/2011 | Morgan et al. | |
| 2018/0010335 | A1 | 1/2018 | Morgan et al. | |

* cited by examiner

*Primary Examiner* — Patrick J Maestri
(74) *Attorney, Agent, or Firm* — Moore & Van Allen PLLC

(57) ABSTRACT

Embodiments of the present invention provide a recessed mounting apparatus, a suspended ceiling and recessed mounting apparatus system, and a method of installing a recessed mounting apparatus. The recessed mounting apparatus includes a recessed mounting frame that forms a partially enclosed space with a lower perimeter defined by flanges configured to sit atop or otherwise connect with portions of a suspended ceiling frame. The recessed mounting apparatus includes or is attached to one or more attachment mechanisms from which equipment like temporary lighting, sound systems, and display projectors can be secured. To support the recessed mounting frame and attachment mechanism, one or more suspension support members are attached at a first end to the recessed mounting frame and at a second end to an overhead structural support.

19 Claims, 16 Drawing Sheets

RECESSED MOUNTING APPARATUS

CROSS-REFERENCE TO RELATED APPLICATIONS

This application is a non-provisional application of and claims priority to U.S. Provisional Application No. 62/826,602, filed on Mar. 29, 2019; the contents of which are also incorporated herein by reference.

BACKGROUND

Multi-functional spaces such as cafetoriums, classrooms, conference rooms, and ballrooms require temporary and/or modular electrical equipment rigging when transforming between the space's functions. For example, a cafetorium may need to serve as a typical cafeteria most of the time, but then may need to be equipped with temporary lighting, sound systems, display projectors when the space is used as an auditorium for a short period of time.

One historical solution to achieving the multi-functional space includes bringing in temporary equipment stands that take up usable space within the cafetorium, rig the stands with electrical equipment, and run electrical power cords (e.g., across the floor of the usable space) to the temporary stands. This process is labor intensive, as stands, equipment, and electrical components have to be put up and taken down every time the space transitions from one functionality to another. Additionally, this solution leaves a large stand in the usable space that can block an audience's view of a stage or be an obstacle to foot traffic within the space, reducing the percentage of the space that remains usable.

Another historical solution to achieving the multi-functional space involves cutting a hole in a drop-down ceiling and securing a retractable (e.g., mechanical, hydraulic, etc.) column into which a pipe can be secured for the purpose of temporarily securing electrical equipment. However, this solution can be expensive, requires multiple moving parts that can fail, and can be difficult to install.

Finally, another historical solution has been to install a permanent equipment attachment apparatus below the ceiling, but this permanent structure would always be visible, would reduce the aesthetic quality of the room when electrical equipment is not needed, and the like.

Therefore, a need exists to provide a functional and aesthetically consistent recessed mounting apparatus that allows for the temporary installation of electrical equipment or other temporary features when needed.

BRIEF DESCRIPTION OF THE DRAWINGS

Figure 1:
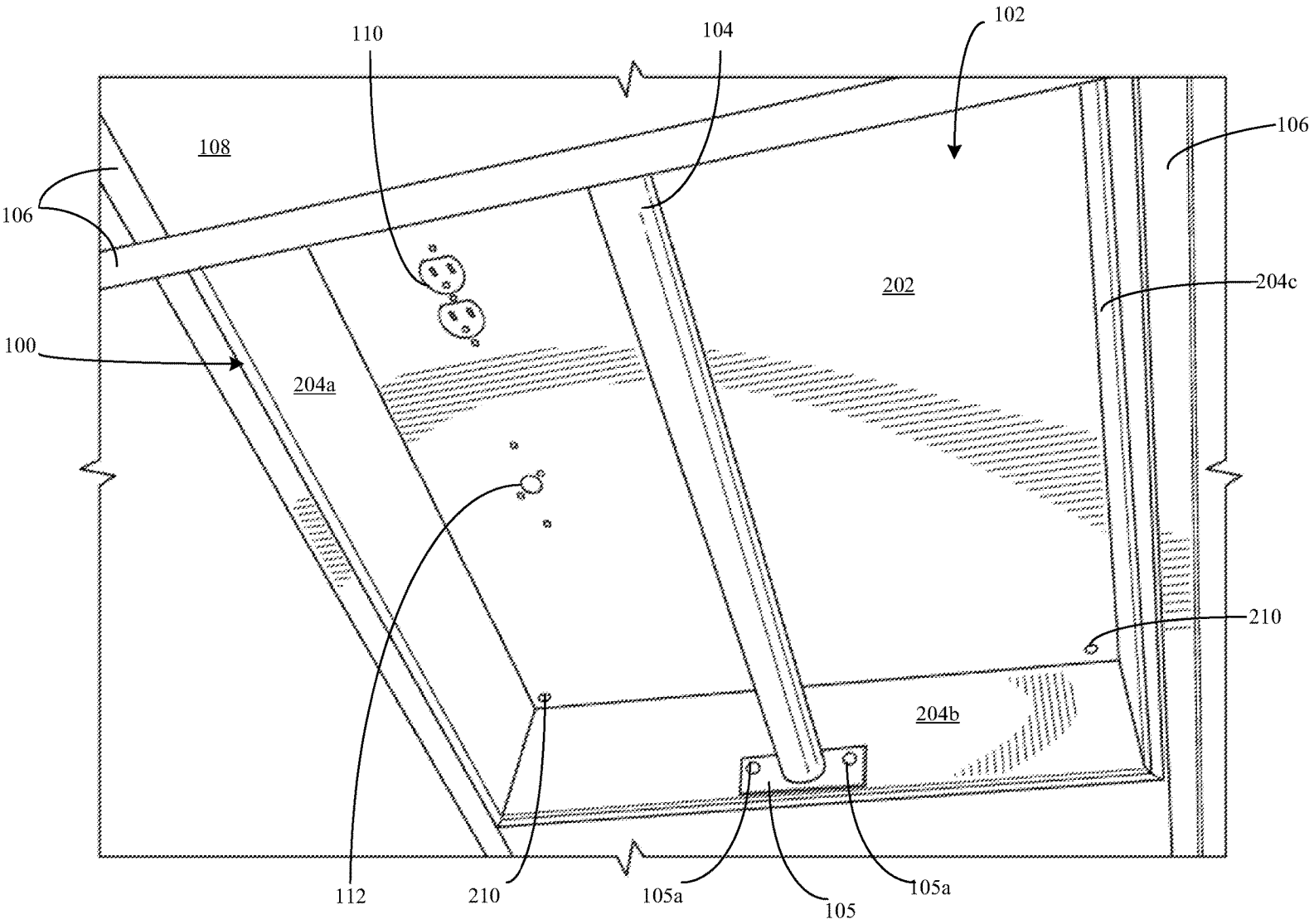
Figure 2:
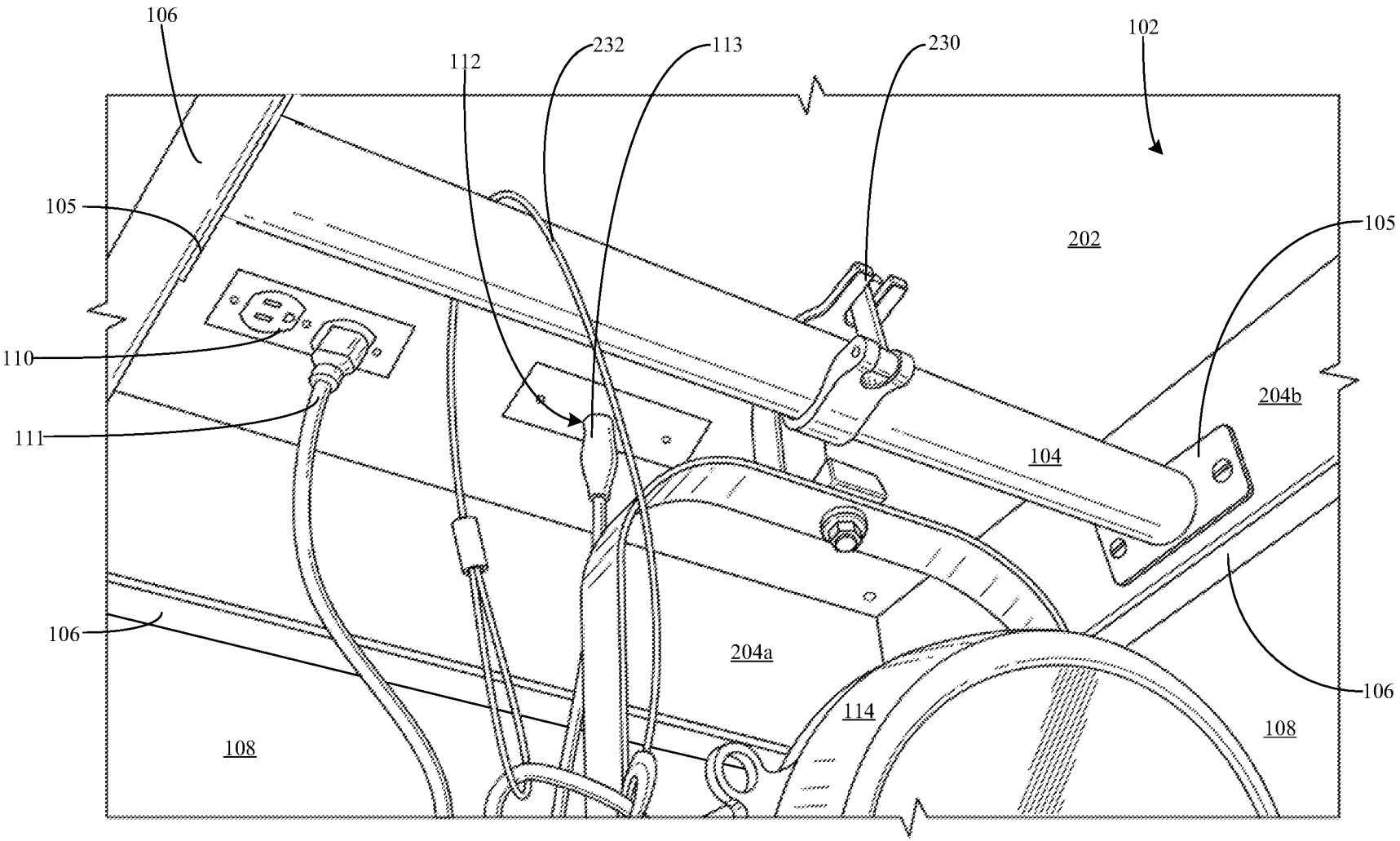
Figure 3:
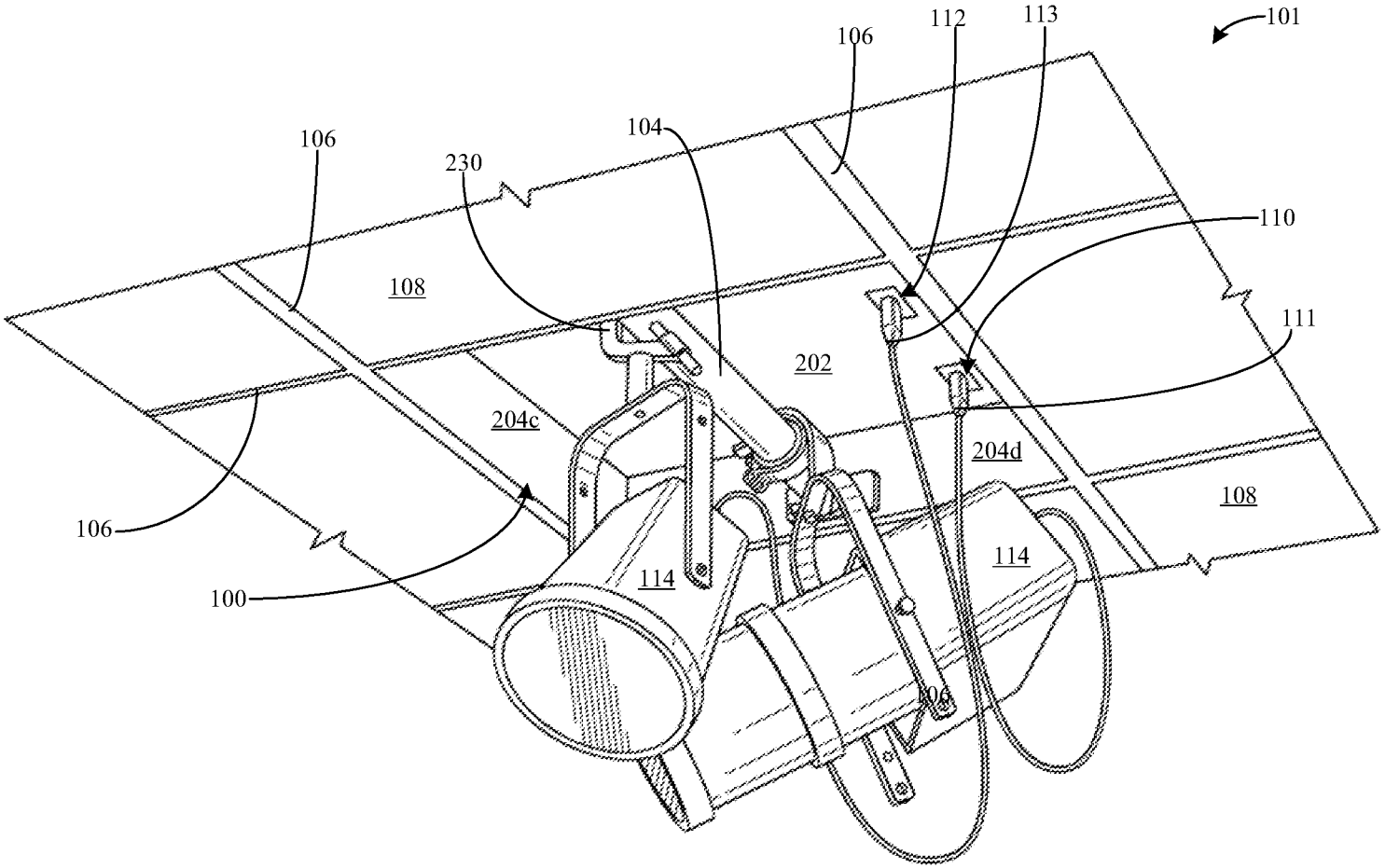
Figure 4:
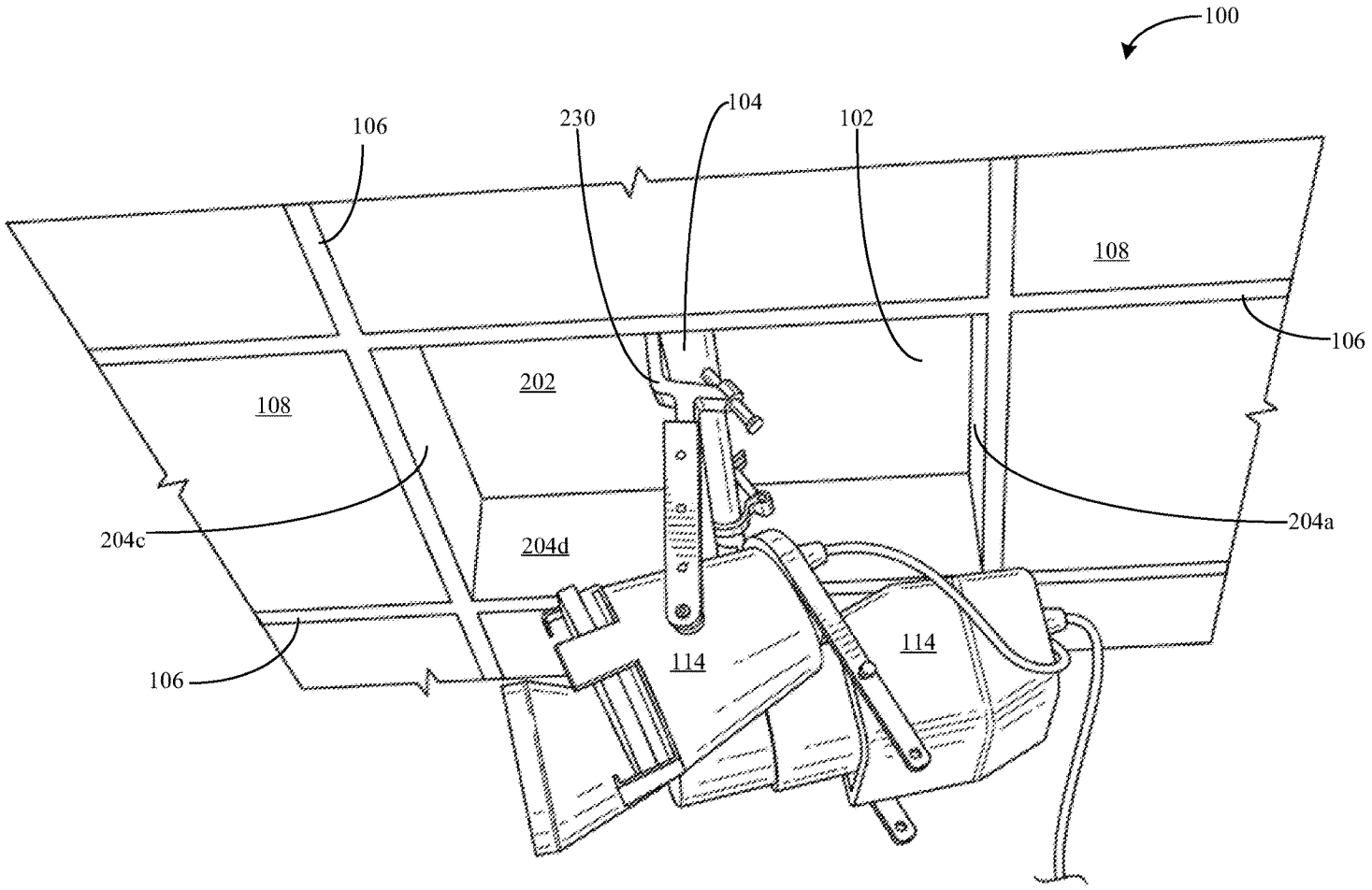
Figure 5:
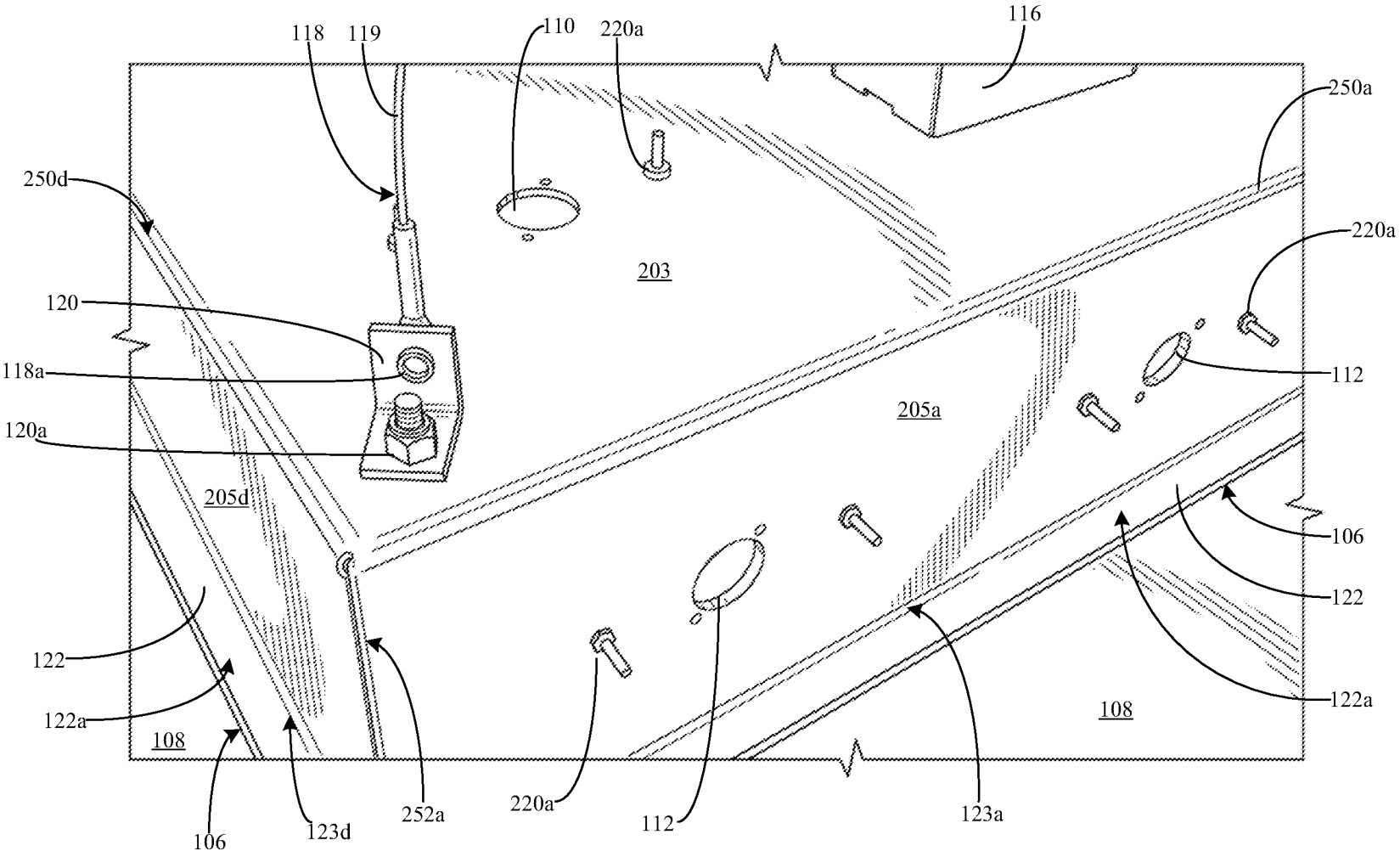
Figure 6:
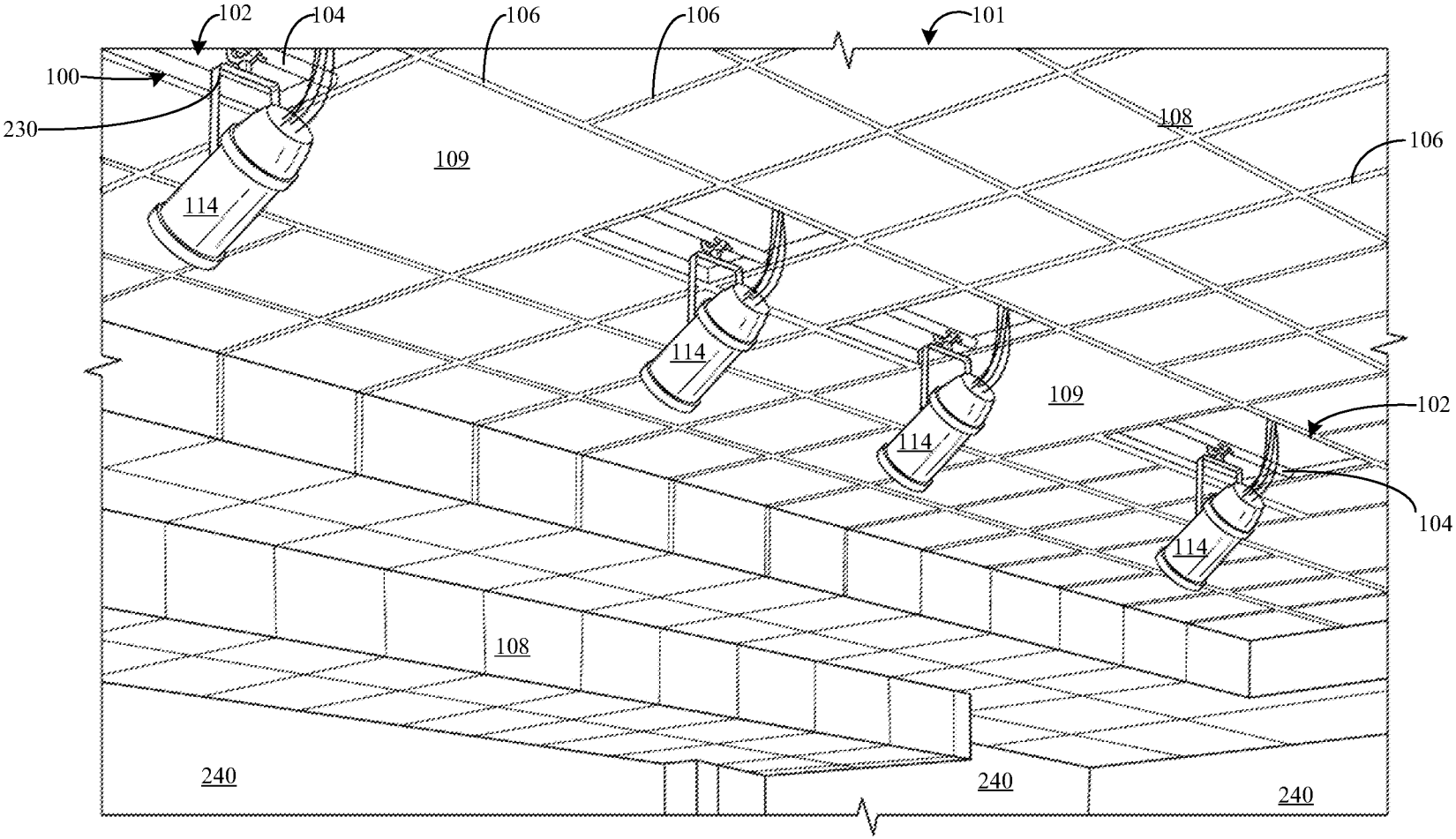
Figure 7:
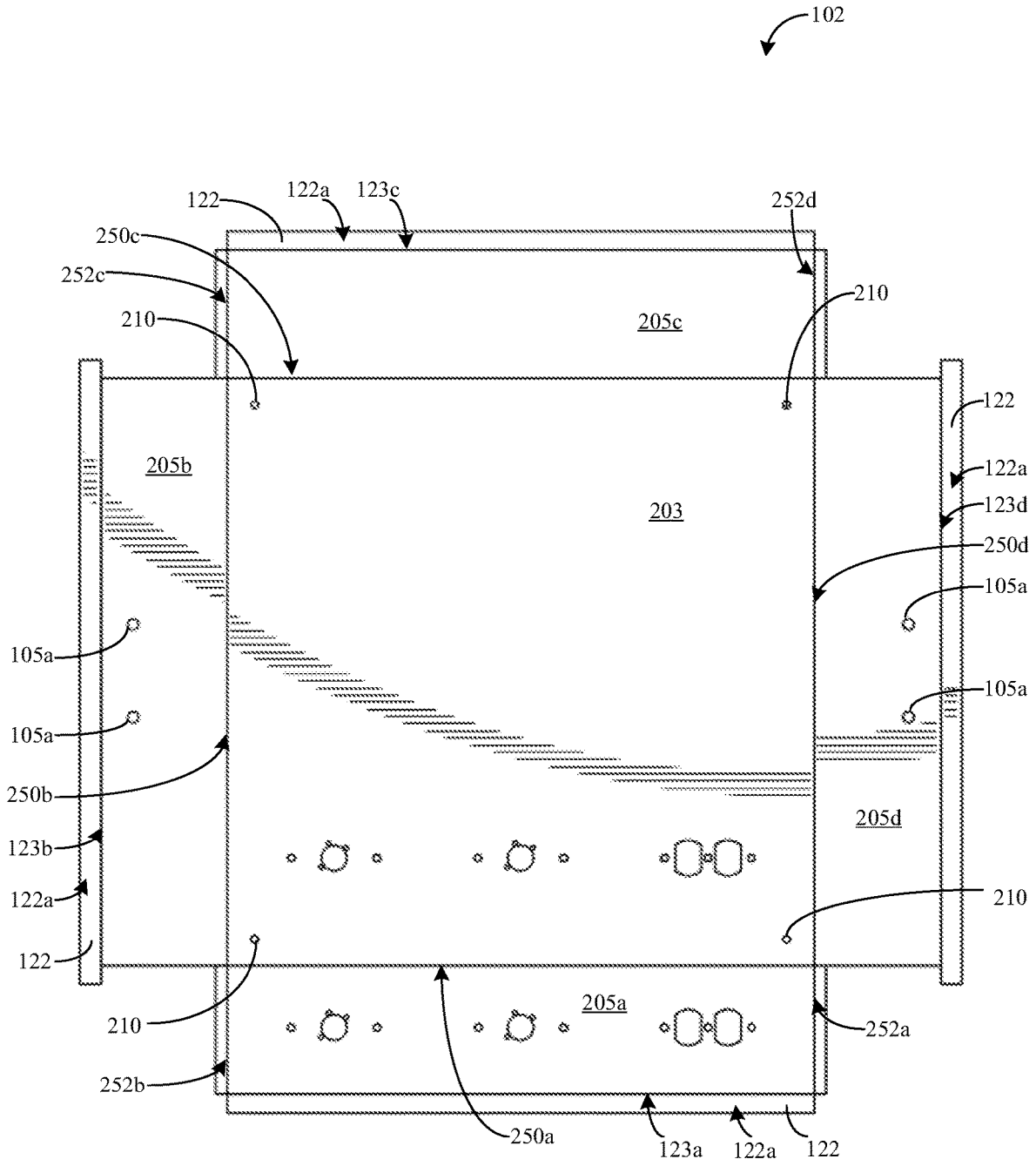
Figure 8:
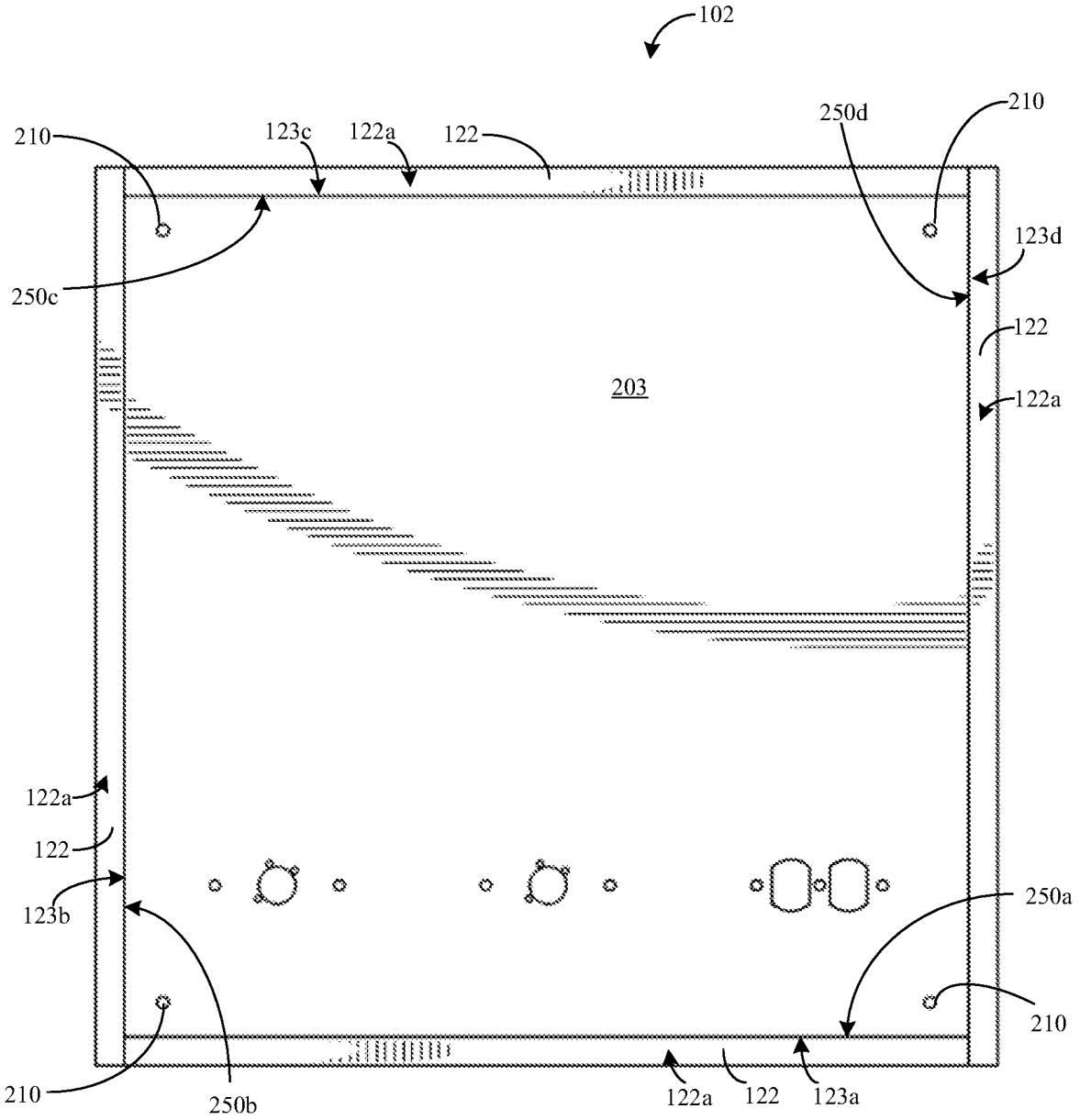
Figure 9:
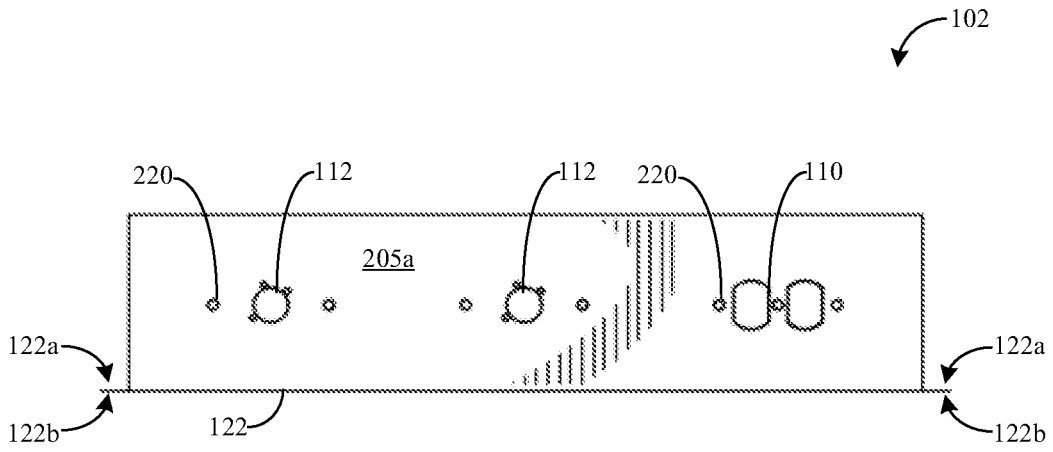
Figure 10:
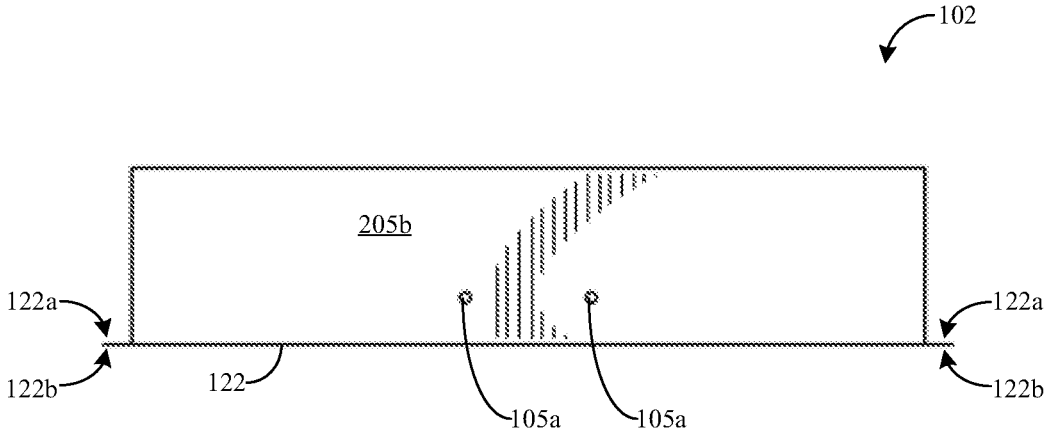
Figure 11:
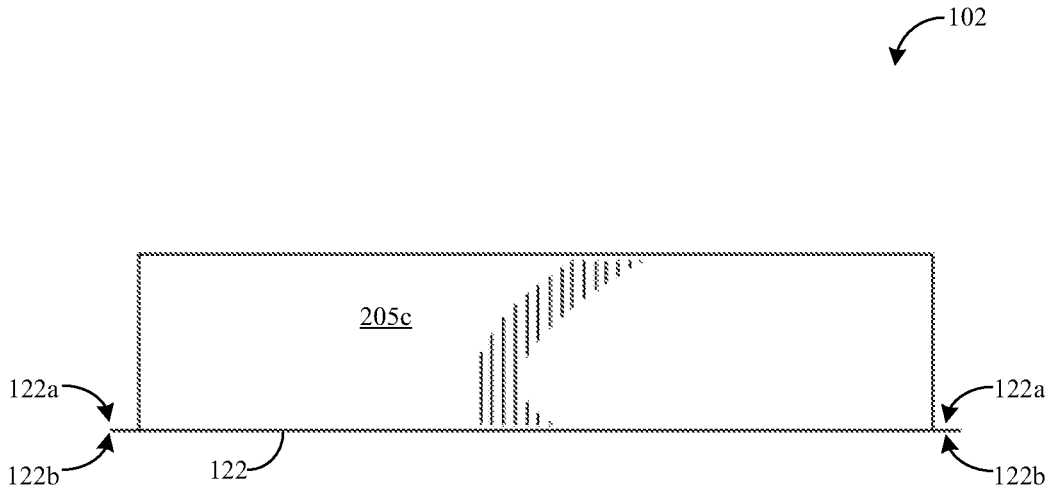
Figure 12:
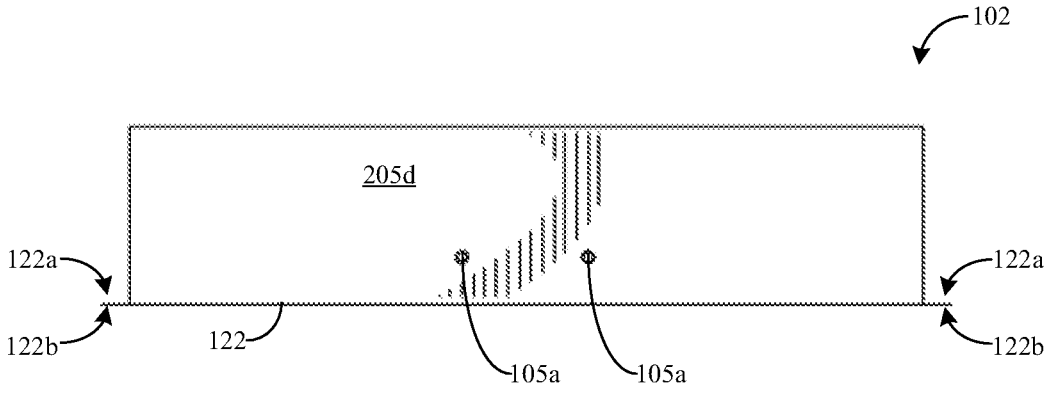
Figure 13:
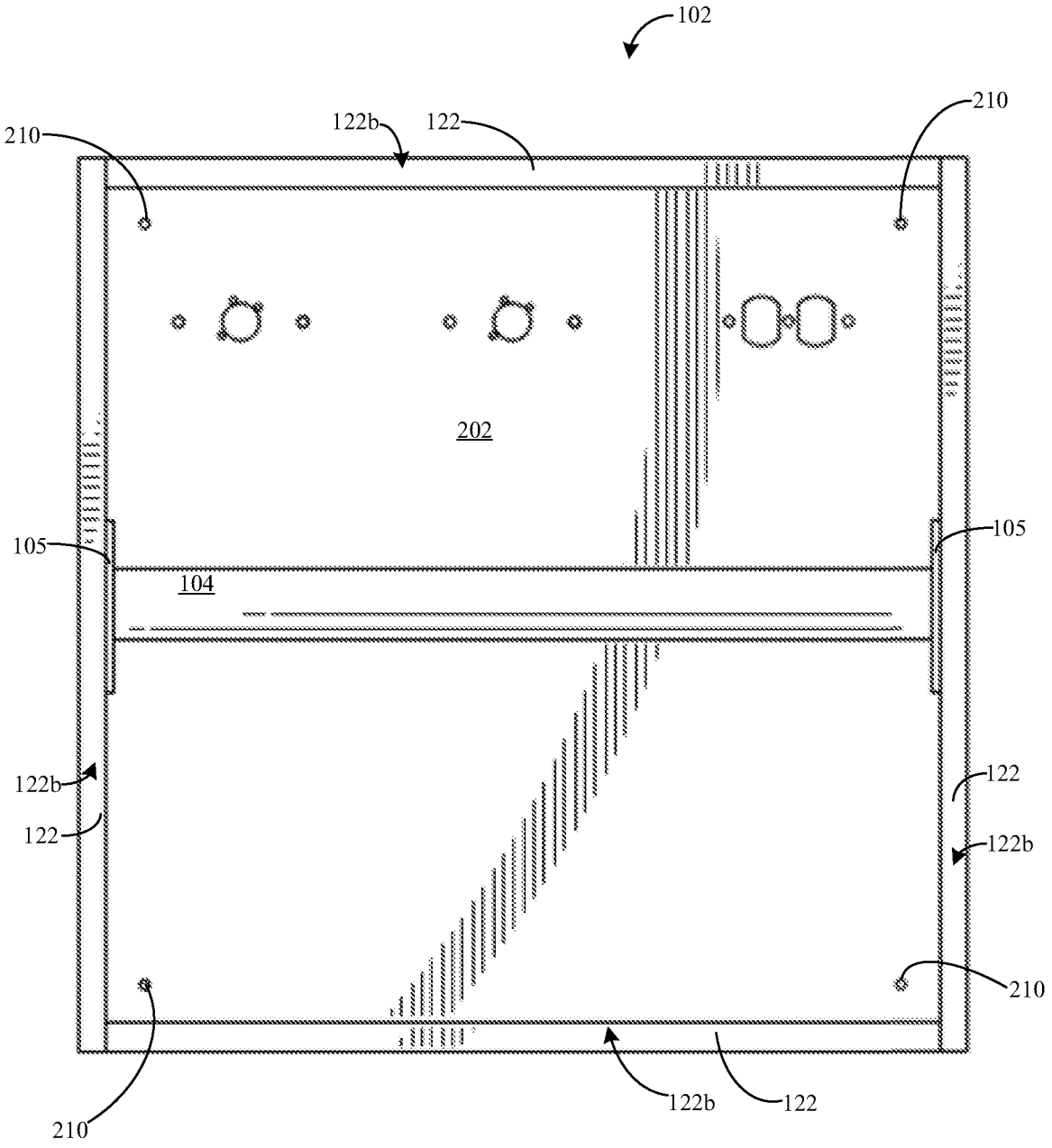
Figure 14:
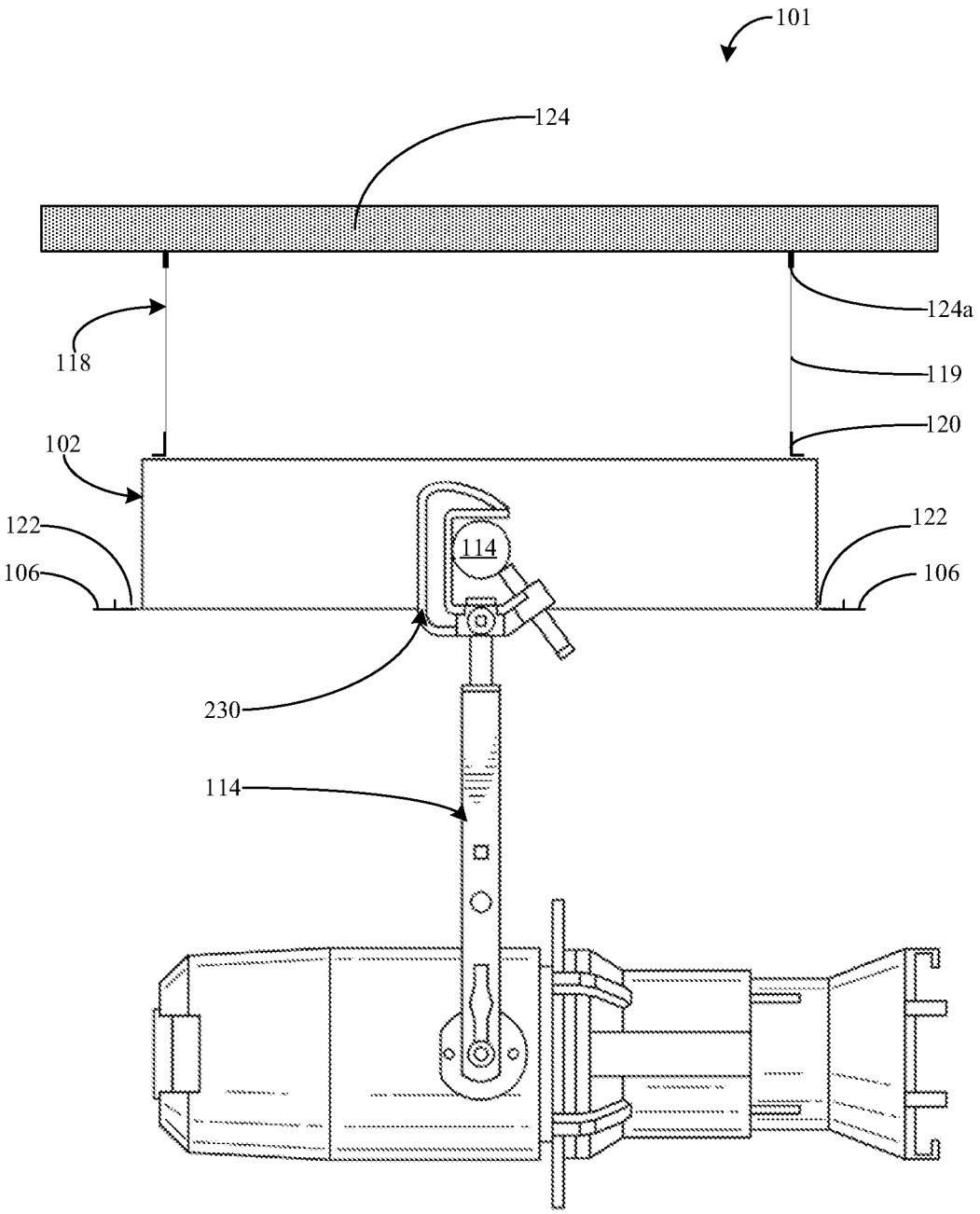
Figure 15:
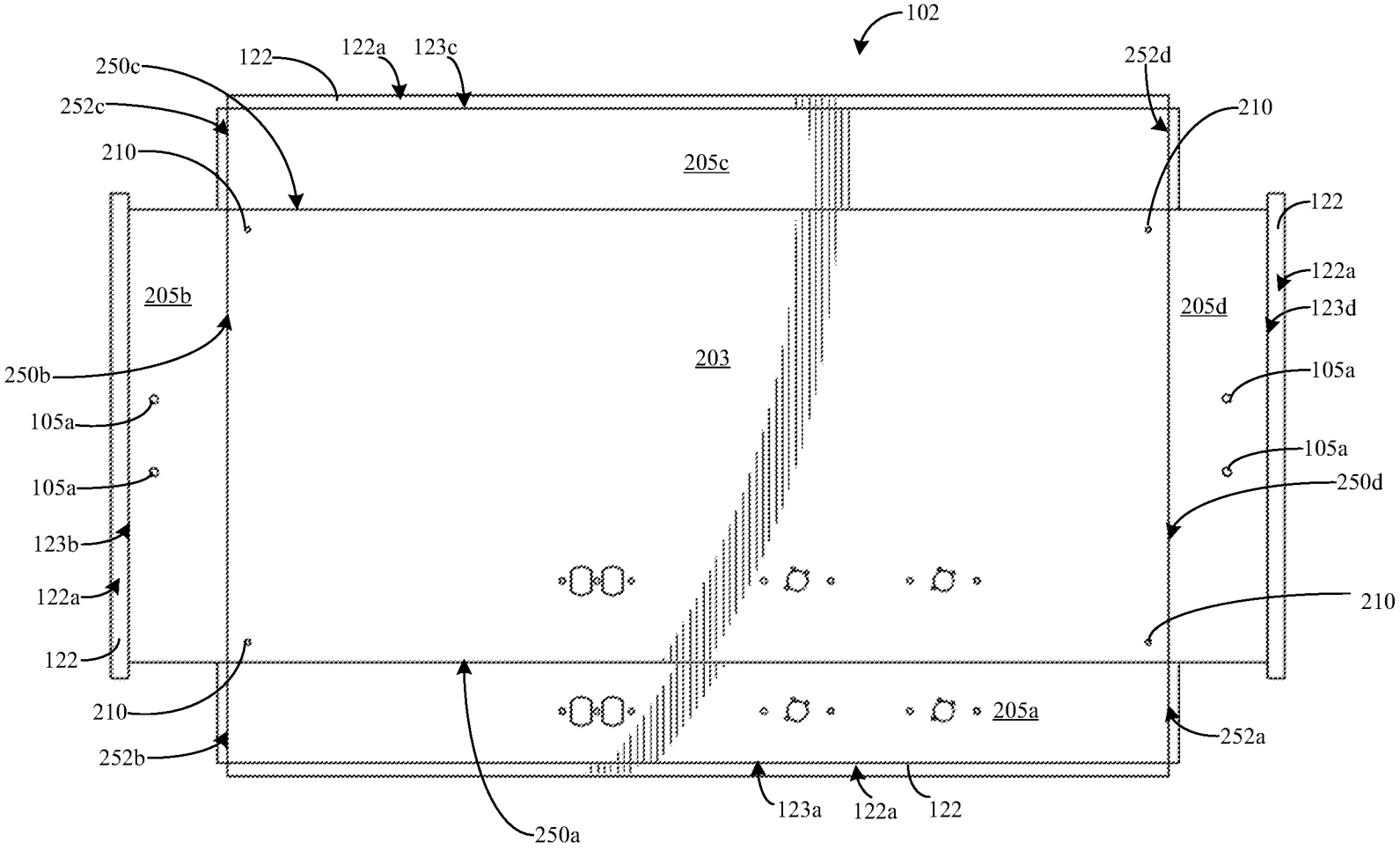
Figure 16:
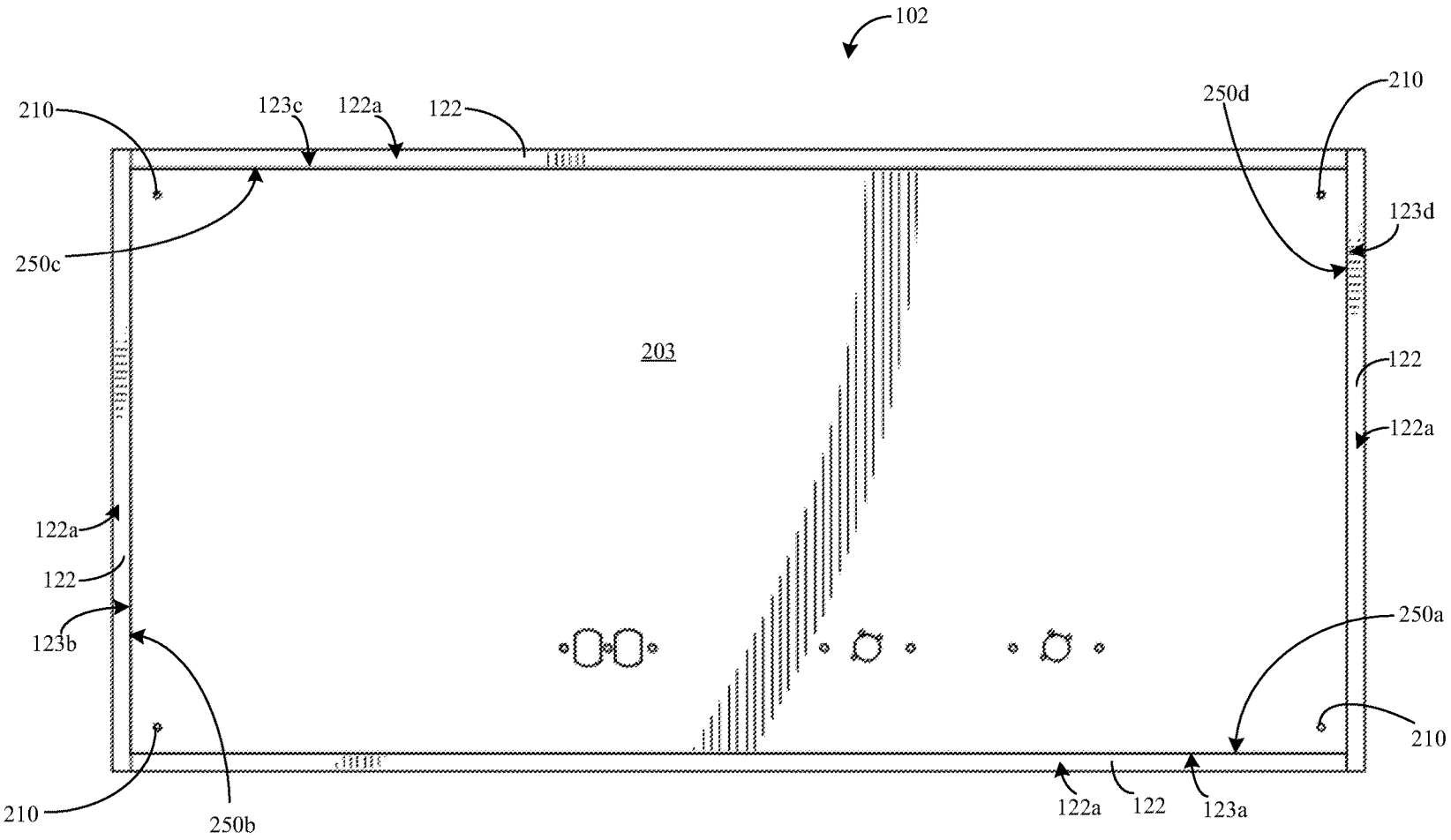
Figure 17:
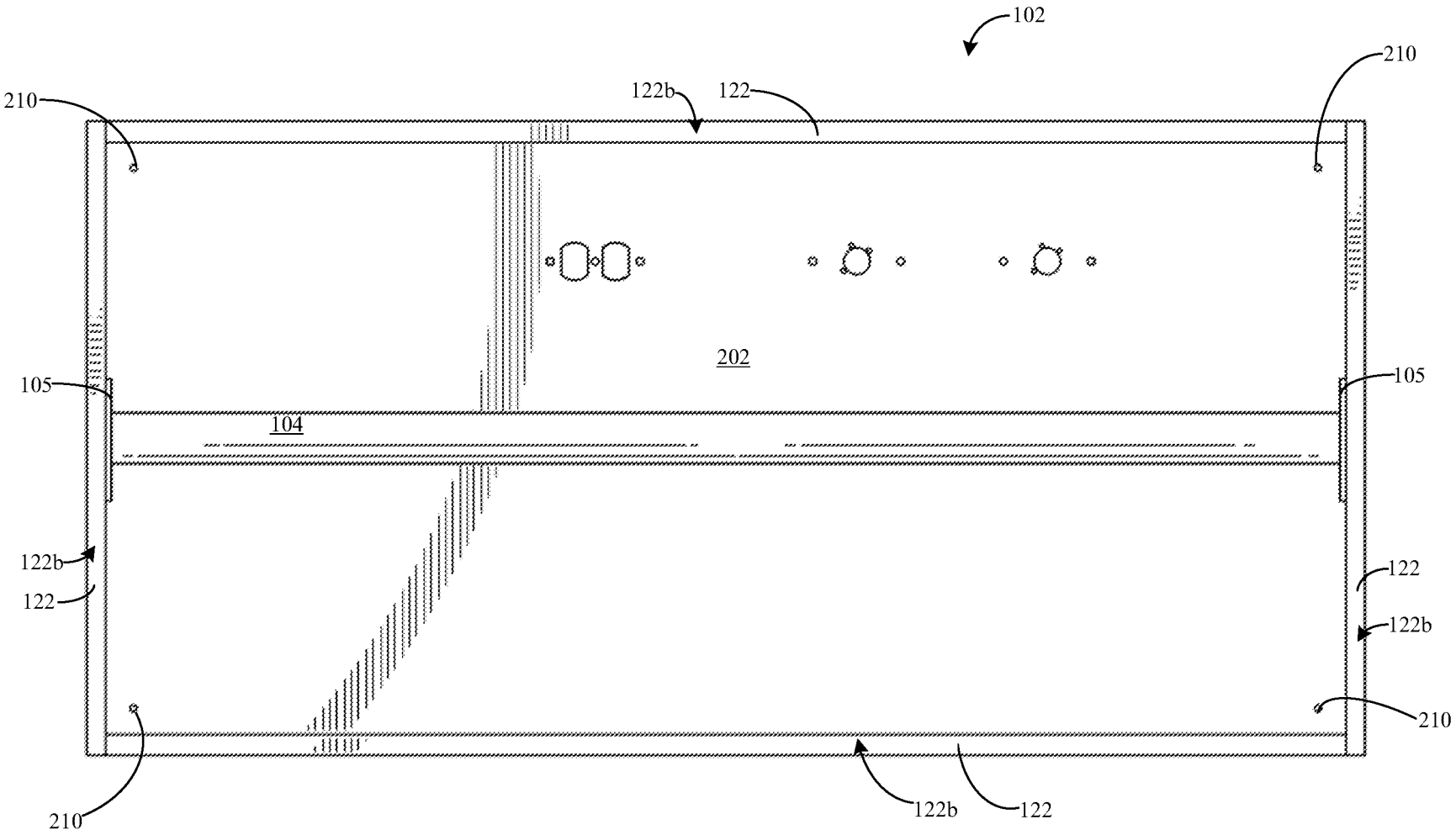
Figure 18:
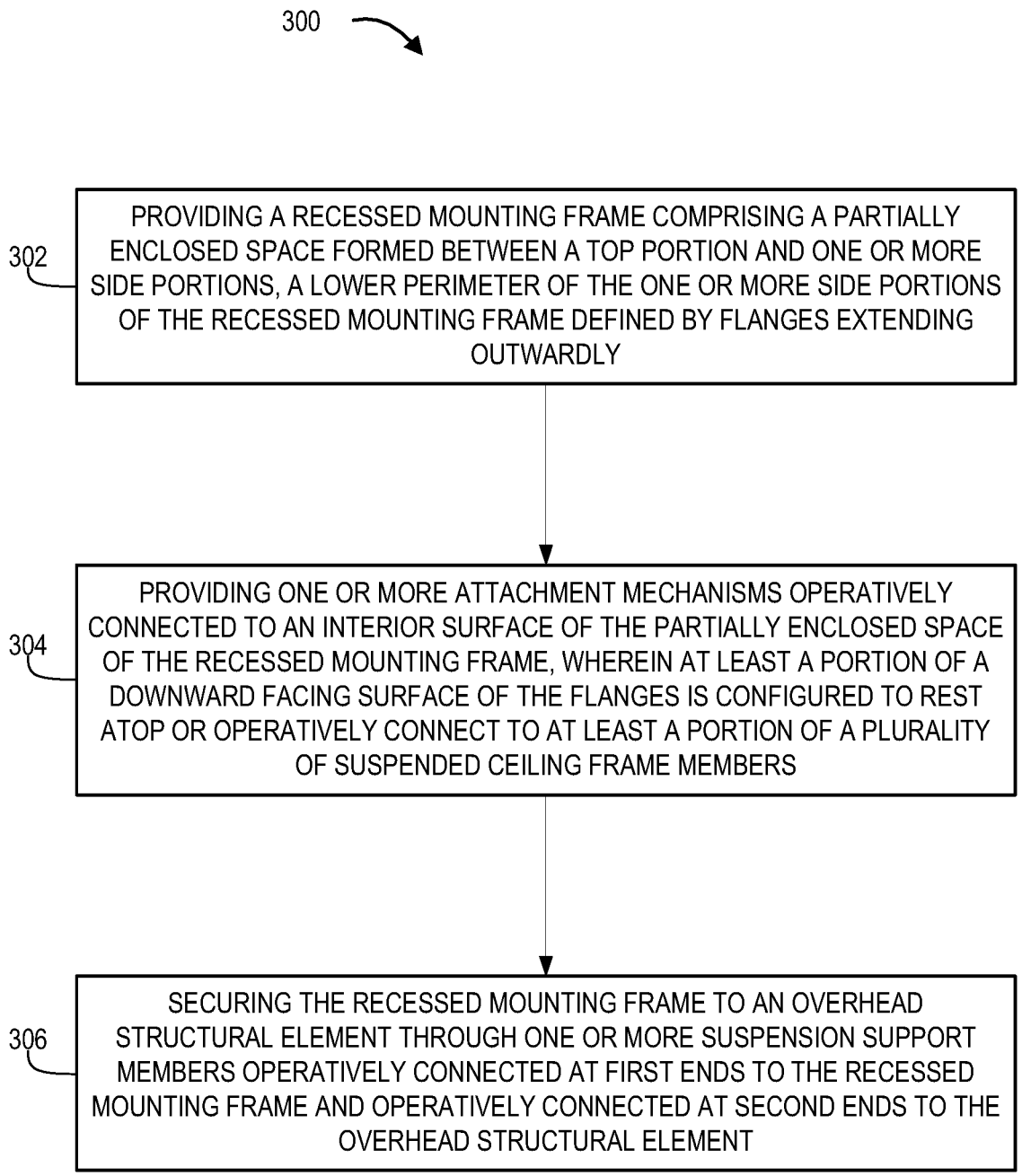

Having thus described embodiments of the invention in general terms, reference will now be made the accompanying drawings, wherein:

FIG. 1 illustrates a perspective view of a recessed mounting apparatus, in accordance with an embodiment of the invention;

FIG. 2 illustrates a perspective view of a recessed mounting apparatus, in accordance with an embodiment of the invention;

FIG. 3 illustrates a perspective view of a recessed mounting apparatus, in accordance with an embodiment of the invention;

FIG. 4 illustrates a perspective view of a recessed mounting apparatus, in accordance with an embodiment of the invention;

FIG. 5 illustrates a perspective view above a recessed mounting apparatus, in accordance with an embodiment of the invention;

FIG. 6 illustrates a perspective view of a drop-down ceiling and recessed mounting apparatus system, in accordance with an embodiment of the invention;

FIG. 7 illustrates a flattened overhead view of a recessed mounting apparatus, in accordance with an embodiment of the invention;

FIG. 8 illustrates an overhead view of a recessed mounting apparatus, in accordance with an embodiment of the invention;

FIGS. 9-12 illustrate side views of the recessed mounting apparatus, in accordance with embodiments of the invention;

FIG. 13 illustrates an underneath view of a recessed mounting apparatus, in accordance with an embodiment of the invention;

FIG. 14 illustrates a side view of a recessed mounting apparatus and overhead structural support, in accordance with an embodiment of the invention;

FIG. 15 illustrates a flattened overhead view of a recessed mounting apparatus, in accordance with an embodiment of the invention;

FIG. 16 illustrates an overhead view of a recessed mounting apparatus, in accordance with an embodiment of the invention;

FIG. 17 illustrates an underneath view of a recessed mounting apparatus, in accordance with embodiments of the invention; and FIG. 18 provides a process flow illustrating a process for installing a recessed mounting apparatus, in accordance with embodiments of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

Embodiments of the present invention provide an apparatus, method, method of manufacture, system, and other embodiments of a recessed mounting apparatus that permits the temporary installation of large electrical or other equipment in a space that has other functionality besides equipment installation. In general, a recessed ceiling support structure with dimensions to fit within a ceiling tile frame (e.g., a 2' by 2' frame, a 2' by 4' frame, or a custom sized frame) of a suspended ceiling or grid ceiling is secured to structural elements above the suspended ceiling by suspension support members. The suspension support members, and the structural elements above the suspended ceiling provide structural and seismic support for the recessed ceiling support structure. One or more attachment members (e.g., poles, rods, hooks, clamps, carabiners, straps, or the like) are secured to the recessed ceiling support structure in a manner that facilitates the attachment of equipment (e.g., electrical equipment). The recessed ceiling support structure may additionally include electrical components including, but not limited to, a power source, a power line, audio and video receptacles, equipment controlling inputs, and the like that are hooked up to the existing electrical system above the recessed ceiling (i.e., hidden from eyesight).

This recessed mounting apparatus is especially useful in multi-functional spaces like event spaces, cafetoriums, ballrooms, school classrooms, dance classrooms, drama classrooms, religious centers, concert venues, auditoriums, theaters, and the like, where the presence of permanent rigging equipment that extends below the ceiling is not desired, and/or holes in ceiling panels (or missing ceiling panels) are not desired for aesthetic, insulation, or noise dampening purposes. The usefulness of this recessed mounting apparatus is apparent in the fact that the apparatus fits seamlessly into a pre-existing recessed ceiling or tiled ceiling structure, does not have any components that permanently extend below the ceiling plane, do not include any noticeable holes to the space above the ceiling, and are generally unnoticeable when equipment is not rigged up to the apparatus. At the same time, the recessed mounting apparatus provides temporary and modular functionality for rigging equipment (e.g., speakers, projectors, lighting, and other features) without setting up additional or new support structures, electrical systems, and the like.

As noted above, the recessed ceiling support structure may generally comprise a five-sided box (i.e., with the sixth side being open across the ceiling plane) that sits at or above the ceiling plane of a recessed ceiling or tile ceiling, and fits within the ceiling frame members. The dimensions of the recessed ceiling support structure are set to fit within the ceiling tile frame members such that the recessed ceiling support structure does not sway or move away from its position within the ceiling. As standard ceiling grids are 2'×2' or 2'×4' in dimension, the ceiling support structure may additionally be in the same dimension(s), at least across the open-faced side of the recessed ceiling support structure. The corners and edges of the recessed ceiling support structure residing above the ceiling plane may be straight, curved, angled, or any combination of the above. The top, or roof of the recessed ceiling support structure may be flat, domed, slanted, angled, or any combination of the foregoing. As such, the recessed ceiling support structure, when not in use, provides a smooth, symmetrical, clean, or otherwise neat indentation above the ceiling plane.

The recessed ceiling support structure (and one or more of the other components of the recessed mounting apparatus) may be made out of any material, including, but not limited to, metal, polymer, wood, carbon fiber, or any other element or composite that can provide structural support for the attachment and suspension of equipment from the recessed ceiling support structure. The recessed ceiling support structure (and one or more of the other components of the recessed mounting apparatus) may be colored, coated, or the like, to be a same shade as other ceiling components (e.g., ceiling tiles, ceiling grids, air intake units, lighting fixtures, HVAC fixtures, or the like). Of course, the color of the components may be any color desired.

Because the recessed ceiling support structure will, at times, support a load (i.e., equipment attached to and suspended from the attachment member secured to the recessed ceiling support structure), one or more (e.g., two, three, four, eight, or the like) suspension support members are operatively coupled to the recessed ceiling support structure, typically on the exterior surface of the recessed ceiling support structure (i.e., facing away from the room in which the recessed ceiling support structure is positioned). These suspension support members may be attached at the top of the recessed ceiling support structure, at sides of the recessed ceiling support structure, at corners of the recessed ceiling support structure, and the like. The suspension support members may comprise suspension rods, suspension cords, suspension lines, struts, threaded rods, bolts, adjustable cable slings, and/or the like. The suspension support members may be secured at a first end to the recessed ceiling support structure by means of a screw, a bolt, an adhesive, a weld, or any other attachment mechanism.

The length of the suspension support members may be set to allow the recessed ceiling support structure to sit within the running frame of a suspended ceiling, but to also bear the majority of the load presented by the recessed ceiling support structure. The use of adjustable suspension cords enables an installer to fit recessed ceiling support structures at any desired distance from the structural support without pre-determining the needed length of the suspension support members.

The second end (or a middle portion, if wrapped around a support) of the suspension support members is operatively coupled to the existing building structure or other structural elements above the suspended ceiling. These structural elements may comprise concrete slabs, steel joists, corrugated metal decking, wooden trusses, roof or ceiling joists, or the like. These structural elements will be required to provide structural support for at least the load capacity of the recessed ceiling support structure and the suspension support members and the connection points there between.

While the recessed ceiling support structure is described as sitting within a recessed ceiling, it should be known that this structure can also be used in a conventional ceiling, where a hole is framed into the ceiling, the recessed ceiling support structure is mounted to a structural support via a joist, and sheet rock is used to leave a clean line around the recessed ceiling support structure as it sits within the conventional ceiling.

Within the recessed ceiling support structure, one or more attachment mechanisms may be operatively coupled within the recessed portion of the recessed ceiling support structure (i.e., facing the room in which the recessed ceiling support structure is located). The attachment mechanism(s) are configured to provide structural and positional support for equipment that will be suspended from the attachment mechanism(s). Therefore, the attachment mechanism(s) may comprise one or more rods, pipes, frames, carabiners, hooks, or the like. Multiple attachment members may be used within a single recessed ceiling support structure to provide two locations for equipment to be secured and suspended from. An attachment member can be operatively coupled, including directly secured, to the recessed ceiling support structure at any point or points within the structure. For example, a rod with attachment flanges on each end may be screwed into two opposing sides of the recessed ceiling support structure. Additionally or alternatively, a rod with attachment flanges on each end may be secured to opposing corners of the recessed ceiling support structure. In some embodiments, the recessed ceiling support structure may include a bar, pipe, or rod that is integrated into the mold of the recessed ceiling support structure such that no additional attachment mechanism is required.

In embodiments where hooks, carabiners, or other devices that my require only a single attachment location are used as an attachment mechanism, these mechanisms may be operatively coupled (including directly attached) to an attachment location at the top of the recessed ceiling support structure. These attachment mechanisms would then suspend from the top of the recessed ceiling support structure and be configured to attach to or be attached to equipment.

In some embodiments, two recessed ceiling support structures have been installed within a room (e.g., several feet or yards apart), and the attachment members for each of these recessed ceiling support structures are configured to secure a pipe, rod, pole, cable, or the like such that the pipe, rod, cable, etc. extends below the ceiling plane and across the room. In this way, a single temporary attachment member can provide installation support across a room that is even more variable than by installing individual attachment members within each ceiling tile section.

In embodiments where the attachment mechanisms (and/or temporary attachment member(s)) and the overall recessed ceiling support structure are configured to support large loads, a chain motor can be used to suspend a lighting truss and multiple lights or other similarly complex and heavy equipment. This recessed mounting apparatus may be configured to support such a load in embodiments where the recessed ceiling support structure is comprised of half-inch metal panels or walls, and where metal struts are welded to both the recessed ceiling support structure and a steel truss or other structural support that is capable of withstanding such loads.

The equipment that may be attached (e.g., temporarily attached, modularly attached, and the like) to the attachment members include, but are not limited to, lighting equipment, audio equipment, video equipment, display features, visual features, projectors, screens, monitors, and the like. Because many of these equipment features include electrical components, the recessed ceiling support structure may be operatively coupled with one or more electrical power and data transfer components to assist in powering, commanding, and otherwise using the electrical components. As such, integrated electrical boxes may be operatively coupled to the exterior of the recessed ceiling support structure (i.e., facing away from the room in which the recessed ceiling support structure is located). For example, an electrical box may be attached at the top of the recessed ceiling support structure, between the recessed ceiling support structure and the existing structural elements above the ceiling grid. However, the recessed ceiling support structure may be configured to position the electrical box(es) on a side of the recessed ceiling support structure in embodiments where this makes the electrical connection easier for an electrician and/or in cases where there is not enough space between the top of the recessed ceiling support structure and the existing support structure above the ceiling.

The electrical box(es) may include power source outlets that are operatively coupled with a side (including the top or roof) of the recessed ceiling support structure such that the outlet sockets are positioned substantially flush with the interior of the recessed ceiling support structure. In this way, power source lines for electrical equipment can easily be plugged into the power source within the recessed ceiling support structure without a power line having to be run across the ceiling, above the ceiling, or across a room every time the equipment is installed.

Similarly, additional electrical components such as video input receptacles, audio input receptacles, equipment control receptacles, or the like, may be operatively coupled with one or more electrical boxes and with one or more sides (including the top) of the recessed ceiling support structure such that associated cable ports are substantially flush with the sides of the recessed ceiling support structure. Again, this facilitates a simple and clean (i.e., no additional cable running or installation) rigging procedure for electrical equipment that utilizes such receptacles.

While the recessed mounting apparatus is designed to be aesthetically pleasing, or at least comprise a clean and complete covering across a ceiling panel area, on its own, one or more coverings may be used to cover the recessed ceiling support structure substantially across the ceiling plane. For example, in embodiments where a pipe or other tubular attachment mechanism is present within the recessed ceiling support structure, a rigid or semi-rigid covering with a first surface that matches or is otherwise complimentary with the other ceiling components, and with a second surface with pipe snap clamps can be snapped into place such that the first side is substantially flush with the ceiling plane and covers substantially all of the ceiling panel space with which the recessed ceiling support structure resides. In this way, the recessed ceiling support structure can be covered up when equipment is not being used. In some embodiments, the cover may comprise one or more magnets that magnetically attach to the recessed ceiling support structure when the cover is in place.

Other covering techniques may also be used, including through the use of a flexible material that can be rolled up onto a roller positioned within the recessed ceiling support structure, such that the material can be pulled across the ceiling panel opening when no equipment is installed within the recessed ceiling support structure.

As noted above, the described solution can improve the usability of common spaces by permitting the temporary installation of electrical and other equipment while not taking up unnecessary space, leaving undesirable holes in a ceiling, not blocking view or usability of the space, and the like when equipment is not mounted. The use of these recessed mounting apparatuses can enable a common drama classroom to become a stage with legitimate lighting, for a typical classroom to become a laboratory or training ground for theater lighting designers or other electrical equipment training.

In some embodiments, the invention described herein may embody a recessed mounting apparatus comprising recessed mounting frame comprising a partially enclosed space formed between a top portion and one or more side portions, a lower perimeter of the one or more side portions of the recessed mounting frame defined by flanges extending outwardly. The recessed mounting apparatus may further comprise one or more attachment mechanisms operatively connected to an interior surface of the partially enclosed space of the recessed mounting frame. Furthermore, the recessed mounting apparatus may comprise one or more suspension support members operatively connected at first ends to the recessed mounting frame.

In some embodiments, at least a portion of a downward facing surface of the flanges of the recessed mounting apparatus is configured to rest atop, or operatively connect to, at least a portion of suspended ceiling frame members.

In some embodiments, the recessed mounting frame of the recessed mounting apparatus may comprise four side portions at substantially right angles to the top portion and the adjacent side portions.

The partially enclosed space of the recessed mounting frame may, in some embodiments, form a substantially circular dome with a single rounded side portion and a rounded or domed top portion. Alternatively, the top portion may be a flat (e.g., parallel with an underlying ground or floor) piece extending across a top end of a circular/rounded side portion, thereby forming a substantially cylindrical partially enclosed space of the recessed mounting frame.

In some embodiments of the recessed mounting apparatus, the attachment mechanism comprises a bar or rod operatively connected at a first end to a first side of the recessed mounting frame and connected at a second end to an opposing side of the recessed mounting frame. The first end of the attachment mechanism may, in some embodiments, comprise one or more flanges attached to the first side of the recessed mounting frame, and wherein the second end of the attachment mechanism comprises one or more flanges attached to the opposing side of the recessed mounting frame.

While the recessed mounting frame and the attachment mechanism are at times described as being two or more separate components that are attached together, it should be known that, in some embodiments, the recessed mounting frame and the attachment mechanism comprise a single component.

The one or more suspension support members may, in some embodiments, be operatively connected at second ends to an overhead structural element.

In some embodiments of the recessed mounting apparatus, one or more electrical power or data transfer components operatively coupled to an exterior surface of the recessed mounting frame.

Whether the electrical power or data transfer components are operatively coupled to the exterior surface of the recessed mounting frame, or are provided in a different manner (e.g., secured to a recessed ceiling frame member, secured to a different ceiling component, secured to a structural component, or the like), one or more power source outlets may be operatively coupled with the top portion or one or more of the side portions of the recessed mounting frame, whereby power source sockets of the one or more power source outlets are positioned substantially flush with the interior surface of the recessed mounting frame. Additionally or alternatively, one or more data transfer outlets may be operatively coupled with the top portion or one or more of the side portions of the recessed mounting frame, whereby one or more data transfer outlets are positioned substantially flush with the interior surface of the recessed mounting frame.

In some embodiments of the recessed mounting apparatus, a removable concealing member may be removably attached to at least a portion of the recessed mounting frame such that, when in an attached configuration, the removable concealing member extends substantially across the lower perimeter of the one or more side portions of the recessed mounting frame.

The above-described recessed mounting apparatus may, in some embodiments, be a component of a suspended ceiling and recessed mounting apparatus system. Such a suspended ceiling and recessed mounting apparatus system may comprise an overhead structural element and a plurality of suspended ceiling frame members positioned below the overhead structural element. Additionally, the system may comprise a recessed mounting frame comprising a partially enclosed space formed between a top portion and one or more side portions, a lower perimeter of the one or more side portions of the recessed mounting frame defined by flanges extending outwardly. One or more attachment mechanisms may be operatively connected to an interior surface of the partially enclosed space of the recessed mounting frame, wherein at least a portion of a downward facing surface of the flanges is configured to rest atop or operatively connect to at least a portion of the plurality of suspended ceiling frame members. Finally, one or more suspension support members may be operatively connected at first ends to the recessed mounting frame and operatively connected at second ends to the overhead structural element.

The overhead structural element may, in some embodiments, be a structural ceiling, overhead metal (e.g., iron) beams, or other structural elements that are configured to support the weight of suspended equipment (including a recessed mounting apparatus with attached suspended equipment). The plurality of suspended ceiling frame members may comprise adjustable cables (e.g., metal cables), hangers, metal rods (e.g., steel brackets), and the like.

In some embodiments, the inventions described herein may be utilized as a method of installing a recessed mounting apparatus in a suspended ceiling. In such embodiments, the method may include providing a recessed mounting frame comprising a partially enclosed space formed between a top portion and one or more side portions, a lower perimeter of the one or more side portions of the recessed mounting frame defined by flanges extending outwardly. The method may additionally include a step of providing one or more attachment mechanisms operatively connected to an interior surface of the partially enclosed space of the recessed mounting frame, wherein at least a portion of a downward facing surface of the flanges is configured to rest atop or operatively connect to at least a portion of a plurality of suspended ceiling frame members.

In some embodiments, the method may further include securing the recessed mounting frame to an overhead structural element through one or more suspension support members operatively connected at first ends to the recessed mounting frame and operatively connected at second ends to the overhead structural element. Such a method may also include providing the plurality of suspended ceiling frame members in a position below the overhead structural element. The ceiling frame members may comprise a common suspended ceiling grid, also known as a drop-down ceiling grid. The method described above is further described with respect to FIG. 18.

Turning now to FIG. 1, a perspective view of the recessed mounting apparatus 100 is provided, including the recessed mounting frame 102 (or a recessed ceiling support structure). The recessed mounting frame 102 includes a top portion 202 and four side portions 204(*a*)-(*d*) (204(*d*) is not shown in FIG. 1) that form and define a partially enclosed space. The recessed mounting frame 102 further includes a plurality of flanges (not shown in FIG. 1) that rest atop or otherwise operatively connect to a plurality of ceiling frame members 106 of a drop-down ceiling structure 108.

An attachment mechanism 104 (illustrated here as a single bar with attachment flanges 105 and attachment flange securing elements 105(*a*)) is operatively connected between two of the interior side portions 204 of the recessed mounting frame (particularly side 204(*b*) and 204(*d*) (not shown)). While FIG. 1 illustrates an embodiment of the recessed mounting apparatus 100 whereby the attachment mechanism 104 is a separate unit, but secured to, the recessed mounting frame 102, it should be known that in some embodiments the attachment mechanism 104 is a continuous component of the recessed mounting frame 102 (e.g., formed together in a single mold, or the like).

The recessed mounting apparatus 100 illustrated in FIG. 1 further includes an electrical power outlet 110 and a digital media outlet 112, each secured to the top portion 202 by outlet attachment elements 220.

FIG. 1 further illustrates several suspension attachment locations 210, whereby bolts, screws, or other connectors can be utilized to secure suspension support members 118 (not shown in FIG. 1) to an exterior surface of the top portion 205 of the recessed mounting frame 102.

FIG. 2 provides another illustration of a perspective view of the recessed mounting apparatus 100, along with the recessed mounting frame 102, an attachment mechanism 104 comprising a pipe with attachment flanges 105, an electrical power cord 111 plugged into an electrical power outlet 110, and a digital media cord 113 plugged into a digital media outlet 112. Additionally, suspended equipment 114 is removably attached via an equipment attachment member 230 to the attachment mechanism 104. An additional equipment safety harness 232 is also shown in FIG. 2 to demonstrate how additional rigging can be accomplished for the attachment mechanism 104 to provide an increased level of safety and security for the attached equipment 114.

FIG. 3 provides another illustration of a perspective view of the recessed mounting apparatus 100 as a component of a drop-down ceiling system 101. FIG. 3 illustrates an embodiment with two suspended equipment 114 elements that suspend below the recessed mounting apparatus 100, and the ceiling grid 108 in general, to provide lighting, video, audio, and the like to an underlying room. It should be noted that when the suspended equipment 114 is detached and removed from the recessed mounting apparatus 100, no elements of the recessed mounting apparatus 100 extend below the ceiling grid 108, creating a clean aesthetic for the room. In some embodiments, the recessed mounting frame 102 can be at least partially concealed by attaching a concealing member (not shown) to the recessed mounting frame 102 (e.g., by clipping a flat panel shaped and colored substantially similar to other ceiling tiles of the ceiling grid 108 to the attachment member 104).

Regarding FIG. 4, a side view from beneath a recessed mounting apparatus 100 is illustrated, whereby suspended equipment 114 is attached.

FIG. 5 illustrates a top, perspective view of a recessed mounting apparatus 100, as positioned atop a ceiling grid 108 system (particularly, resting atop ceiling frame members 106). As illustrated, the recessed mounting frame 102 includes flanges 122 that extend substantially outwardly from the partially enclosed space of the recessed mounting frame (e.g., at right angles to the recessed mounting frame sides 205). These flanges 122 rest atop ceiling frame members 106 (e.g., runners, supports, and the like), that are configured to support light-weight ceiling tiles, but not objects as heavy as lighting equipment, speakers, and the like. The ceiling frame members 106 may include additional elements to keep the recessed mounting frame 102 from swaying. In FIG. 5, upward facing portions 122*a* of the flanges are illustrated. downward facing portions 122*b* (not shown in FIG. 5) are the components of the flanges 122 that rest atop, or otherwise operatively connect with the ceiling frame members 106.

Because the ceiling frame members are not configured to support suspended equipment 114 alone, the recessed mounting frame 102 is secured to an overhead structural support element 124 (not shown in FIG. 5). As such, one or more suspension support members 118 are attached to the recessed mounting frame through suspension attachment mechanisms 120. In some embodiments, the suspension attachment mechanism 120 is secured to the recessed mounting apparatus 102 via a connector element 120*a*. Similarly, the suspension attachment mechanism 120 may be secured to thee suspension support member 118 via a connector element 118*a*. The overhead structural element 124 is a structural component of a building, room, or other area in which the recessed mounting apparatus 100 is positioned. As such, the overhead structural element 124 is configured to support heavier objects than ceiling tiles, and building codes and regulations may require suspended equipment 114 to be supported by a structural element 124. Therefore, because the recessed mounting apparatus 100 is supported by the structural element 124, the recessed mounting apparatus 100 can in turn support objects such as the suspended equipment 114.

FIG. 5 further illustrates several connector elements 220*a* for electrical power outlets 110 and/or digital media outlets 112. Additionally, an electrical box 116 is operatively connected to the exterior surface of the top 203 of the recessed mounting frame. The electrical box 116 may be connected to an electrical power grid of a building, room, or other area in which the recessed mounting apparatus 100 is positioned, and is configured to convert the electrical power to be useful by elements plugged into the electrical power outlets 110 and/or the digital media outlets 112 of the recessed mounting apparatus 100.

Examples of corners 250*a*, 250*d* of the recessed mounting frame 102 are additionally illustrated in FIG. 5. Additionally, examples of corners 12*d* and 123*a* are illustrated in FIG. 5.

FIG. 6 illustrates a wide view of a drop-down ceiling and recessed mounting apparatus system 101 of a room with walls 240 and recessed lighting elements 109. As shown in FIG. 6, four recessed mounting apparatuses 100 are provided within a large drop-down ceiling structure 108 that includes a plurality of ceiling frame members 106. Suspended equipment 114 is attached to the recessed mounting apparatuses 100. The view shown in FIG. 6 illustrates how a room can be modularly transformed to provide different suspended equipment depending on needs of a user, including the removal of all suspended equipment 114 when not needed.

FIG. 7 illustrates a flattened-out view of a recessed mounting frame 102, including flanges 122 for operative connection with ceiling frame members 106. The view of FIG. 7 illustrates the external and/or upward facing portions of the recessed mounting frame 102. For example, the upward-facing top 203 of the recessed mounting frame, the externally-facing sides 205(*a*)-(*d*) of the recessed mounting frame, and the upward-facing sides of the flanges 122*a* are illustrated.

The recessed mounting frame 102 is put together by folding along the edges 205(*a*)-(*d*), and the sides 252(*a*)-(*d*) to create a partially enclosed space. Furthermore, the flanges 122 are extended outwardly from the partially enclosed space by folding along the edges 123(*a*)-(*b*).

FIG. 8 illustrates a top view of the recessed mounting frame 102, particularly illustrating the upward-facing top portion 203 and the upward-facing sides 122*a* of the flanges.

As described herein, a lower perimeter of the recessed mounting frame 102 is created and defined by the flanges 122 in the folded, installed position of the recessed mounting frame 102. This lower perimeter may, in some embodiments, have dimensions of substantially a two (2) foot by two (2) foot square, which is a common size for drop-down ceiling tiles. In other embodiments (e.g., FIGS. 16 and 17), the lower perimeter may have dimensions of substantially a two (2) foot by four (4) foot rectangle, which is another common size for drop-down ceiling tiles. As such, the recessed mounting frame 102 can replace the spaces of suspended ceilings where existing ceiling tiles are located.

FIGS. 9-12 illustrate side views of the recessed mounting frame 102. FIG. 13 illustrates a view from beneath a recessed mounting frame 102 (e.g., as it would be installed in a suspended ceiling).

FIG. 14 illustrates one embodiment of a recessed mounting apparatus 100, including an illustration of how the recessed mounting apparatus 100 is secured to a structural overhead element 124. As shown in FIG. 14, suspension attachment mechanisms operatively connect the recessed mounting frame 102 to suspension support members 118 (e.g., a cable, a metal rod, a metal strut, or the like). The suspension support members 118 are in turn secured to the overhead structural support element 124 to provide adequate support to allow for the suspension of suspended equipment 114 from the attachment mechanism 104 or the recessed mounting apparatus 100. The suspension support members 118 may be secured to the overhead structural support element 124 through connecting elements 124*a* (e.g., screws and bolts, cement, welding, and the like).

FIGS. 15-17 illustrate embodiments of a flattened view, a constructed overhead view, and a constructed underneath view of a recessed mounting apparatus 100, respectively, that, when in a constructed configuration, forms substantially a two (2) foot by four (4) foot lower perimeter.

As described herein, the recessed mounting apparatus 100 can be modified or customized to rest on any sized and shaped lower perimeter (e.g., as needed to rest atop or otherwise operatively connect to ceiling frame members 106).

FIG. 18 provides a flowchart illustrating a process 300 for installing a recessed mounting apparatus, of the kind described above as the recessed mounting apparatus 100. As shown at block 302 of FIG. 18, the process 300 may include providing a recessed mounting frame comprising a partially enclosed space formed between a top portion and one or more side portions, a lower perimeter of the one or more side portions of the recessed mounting frame defined by flanges extending outwardly.

In some embodiments, the process 300 may also include providing a suspended ceiling that includes ceiling frame members and optionally, ceiling tiles.

Furthermore, the process 300 may include providing one or more attachment mechanisms operatively connected to an interior surface of the partially enclosed space of the recessed mounting frame, wherein at least a portion of a downward facing surface of the flanges is configured to rest atop or operatively connect to at least a portion of a plurality of suspended ceiling frame members, as shown at block 304.

Finally, in some embodiments, the process 300 may involve block 306 of Securing the recessed mounting frame to an overhead structural element through one or more suspension support members operatively connected at first ends to the recessed mounting frame and operatively connected at second ends to the overhead structural element.

As will be appreciated by one of skill in the art, the present invention may be embodied as a method (including, for example, a computer-implemented process, a business process, and/or any other process), apparatus (including, for example, a system, machine, device, computer program product, and/or the like), or a combination of the foregoing.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. A recessed mounting apparatus comprising:

a recessed mounting frame defined by a top portion and one or more side portions, the recessed mounting frame comprising a partially enclosed space formed between the top portion and the one or more side portions, wherein a lower perimeter of the one or more side portions of the recessed mounting frame is defined by flanges extending outwardly, and wherein at least a portion of a downward facing surface of the flanges is configured to rest atop or operatively connect to at least a portion of suspended ceiling frame members;

one or more attachment mechanisms operatively connected to an interior surface of the partially enclosed space of the recessed mounting frame; and one or more suspension support members operatively connected at first ends to the recessed mounting frame.

2. The recessed mounting apparatus of claim 1, wherein the recessed mounting frame comprises four side portions at substantially right angles to the top portion and adjacent side portions.

3. The recessed mounting apparatus of claim 1, wherein the partially enclosed space forms substantially a circular dome with a single rounded side portion and a rounded top portion.

4. The recessed mounting apparatus of claim 1, wherein the attachment mechanism comprises a bar or rod operatively connected at a first end to a first side of the recessed mounting frame and connected at a second end to an opposing side of the recessed mounting frame.

5. The recessed mounting apparatus of claim 4, wherein the first end of the attachment mechanism comprises one or more flanges attached to the first side of the recessed mounting frame, and wherein the second end of the attachment mechanism comprises one or more flanges attached to the opposing side of the recessed mounting frame.

6. The recessed mounting apparatus of claim 1, wherein the recessed mounting frame and the attachment mechanism comprise a single component.

7. The recessed mounting apparatus of claim 1, wherein the one or more suspension support members are operatively connected at second ends to an overhead structural element.

8. The recessed mounting apparatus of claim 1, further comprising one or more electrical boxes operatively coupled to an exterior surface of the recessed mounting frame, wherein the electrical boxes are configured to convert electrical power for electrical power outlets or digital media components.

9. The recessed mounting apparatus of claim 1, further comprising one or more power source outlets operatively coupled with the top portion or one or more of the side portions of the recessed mounting frame, whereby power source sockets of the one or more power source outlets are positioned substantially flush with the interior surface of the recessed mounting frame.

10. The recessed mounting apparatus of claim 1, further comprising one or more data transfer outlets operatively coupled with the top portion or one or more of the side portions of the recessed mounting frame, whereby one or more data transfer outlets are positioned substantially flush with the interior surface of the recessed mounting frame.

11. The recessed mounting apparatus of claim 1, further comprising a removable concealing member removably attached to at least a portion of the recessed mounting frame and extending substantially across the lower perimeter of the one or more side portions of the recessed mounting frame.

12. A suspended ceiling and recessed mounting apparatus system comprising:

an overhead structural element;

a plurality of suspended ceiling frame members positioned below the overhead structural element;

a recessed mounting frame defined by a top portion and one or more side portions, the recessed mounting frame comprising a partially enclosed space formed between the top portion and the one or more side portions, wherein a lower perimeter of the one or more side portions of the recessed mounting frame defined by flanges extending outwardly, and wherein at least a portion of a downward facing surface of the flanges is configured to rest atop or operatively connect to at least a portion of suspended ceiling frame members;

one or more attachment mechanisms operatively connected to an interior surface of the partially enclosed space of the recessed mounting frame; and one or more suspension support members operatively connected at first ends to the recessed mounting frame and operatively connected at second ends to the overhead structural element.

13. The suspended ceiling and recessed mounting apparatus system of claim 12, wherein the recessed mounting frame comprises four side portions at substantially right angles to the top portion and adjacent side portions.

14. The suspended ceiling and recessed mounting apparatus system of claim 12, wherein the partially enclosed space forms substantially a circular dome with a single rounded side portion and a rounded top portion.

15. The suspended ceiling and recessed mounting apparatus system of claim 12, wherein the attachment mechanism comprises a bar or rod operatively connected at a first end to a first side of the recessed mounting frame and connected at a second end to an opposing side of the recessed mounting frame.

16. The suspended ceiling and recessed mounting apparatus system of claim 15, wherein the first end of the attachment mechanism comprises one or more flanges attached to the first side of the recessed mounting frame, and wherein the second end of the attachment mechanism comprises one or more flanges attached to the opposing side of the recessed mounting frame.

17. The suspended ceiling and recessed mounting apparatus system of claim 12, wherein the recessed mounting frame and the attachment mechanism comprise a single component.

18. The suspended ceiling and recessed mounting apparatus system of claim 12, further comprising one or more electrical boxes operatively coupled to an exterior surface of the recessed mounting frame, wherein the electrical boxes are configured to convert electrical power for electrical power outlets or digital media components.

19. A method of installing a recessed mounting apparatus in a suspended ceiling, the method comprising:

providing a recessed mounting frame defined by a top portion and one or more side portions, the recessed mounting frame comprising a partially enclosed space formed between the top portion and the one or more side portions, wherein a lower perimeter of the one or more side portions of the recessed mounting frame defined by flanges extending outwardly, and wherein at least a portion of a downward facing surface of the flanges is configured to rest atop or operatively connect to at least a portion of suspended ceiling frame members;

providing one or more attachment mechanisms operatively connected to an interior surface of the partially enclosed space of the recessed mounting frame; and securing the recessed mounting frame to an overhead structural element through one or more suspension support members operatively connected at first ends to the recessed mounting frame and operatively connected at second ends to the overhead structural element.

* * * * *